US005836786A

United States Patent [19]

Pepe

[11] Patent Number: 5,836,786

[45] Date of Patent: Nov. 17, 1998

[54] PATCH PANEL HAVING SNAP TOGETHER CONSTRUCTION

[75] Inventor: Paul John Pepe, Winston-Salem, N.C.

[73] Assignee: The Whitaker Corporation, Wilmington, Del.

[21] Appl. No.: 651,062

[22] Filed: May 21, 1996

[51] Int. Cl.[6] ..... H01R 13/74

[52] U.S. Cl. ..... 439/557; 439/540.1

[58] Field of Search ..... 439/557, 558, 439/540.1

[56] References Cited

U.S. PATENT DOCUMENTS

| | | | |
|---|---|---|---|
| 3,957,335 | 5/1976 | Troy | 339/97 |
| 4,717,358 | 1/1988 | Chaundy | 439/557 |
| 4,894,024 | 1/1990 | Debortoli et al. | 439/535 |
| 4,920,453 | 4/1990 | Onose et al. | 361/392 |
| 5,178,554 | 1/1993 | Siemon et al. | 439/188 |
| 5,238,426 | 8/1993 | Arnett | 439/557 |
| 5,328,388 | 7/1994 | Fust et al. | 439/540.1 |
| 5,356,311 | 10/1994 | Liu | 439/540.1 |
| 5,385,488 | 1/1995 | Clark | 439/557 |
| 5,401,193 | 3/1995 | Lo Cicero et al. | 439/713 |
| 5,487,683 | 1/1996 | Carlson, Jr. | 439/491 |
| 5,632,648 | 5/1997 | Liu | 439/550 |

*Primary Examiner*—Gary F. Paumen
*Attorney, Agent, or Firm*—Robert Kapalka

[57] ABSTRACT

Components of a patch panel snap together for easy assembly and disassembly. The patch panel includes a mounting panel, an interface housing with a snap latch attachment to the mounting panel, and a connector assembly with a snap latch attachment to the interface housing. The connector assembly can be removed from the patch panel without removing the interface housing.

6 Claims, 7 Drawing Sheets

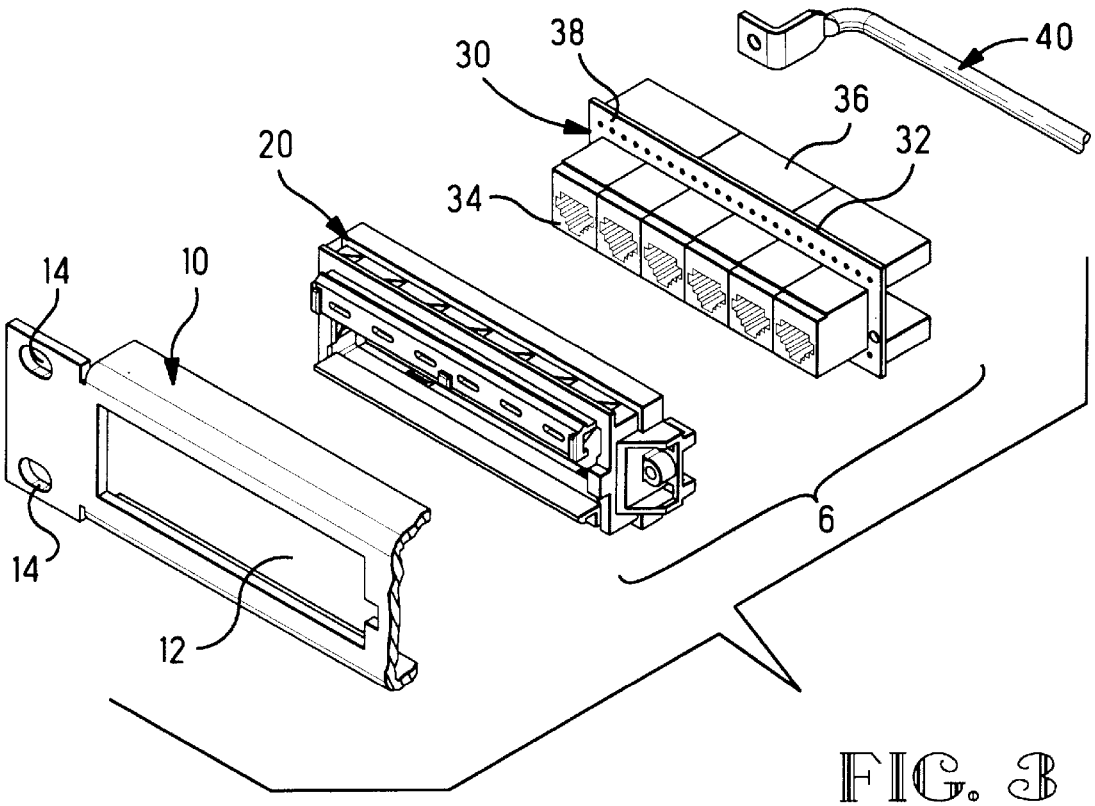
FIG. 3
FIG. 4
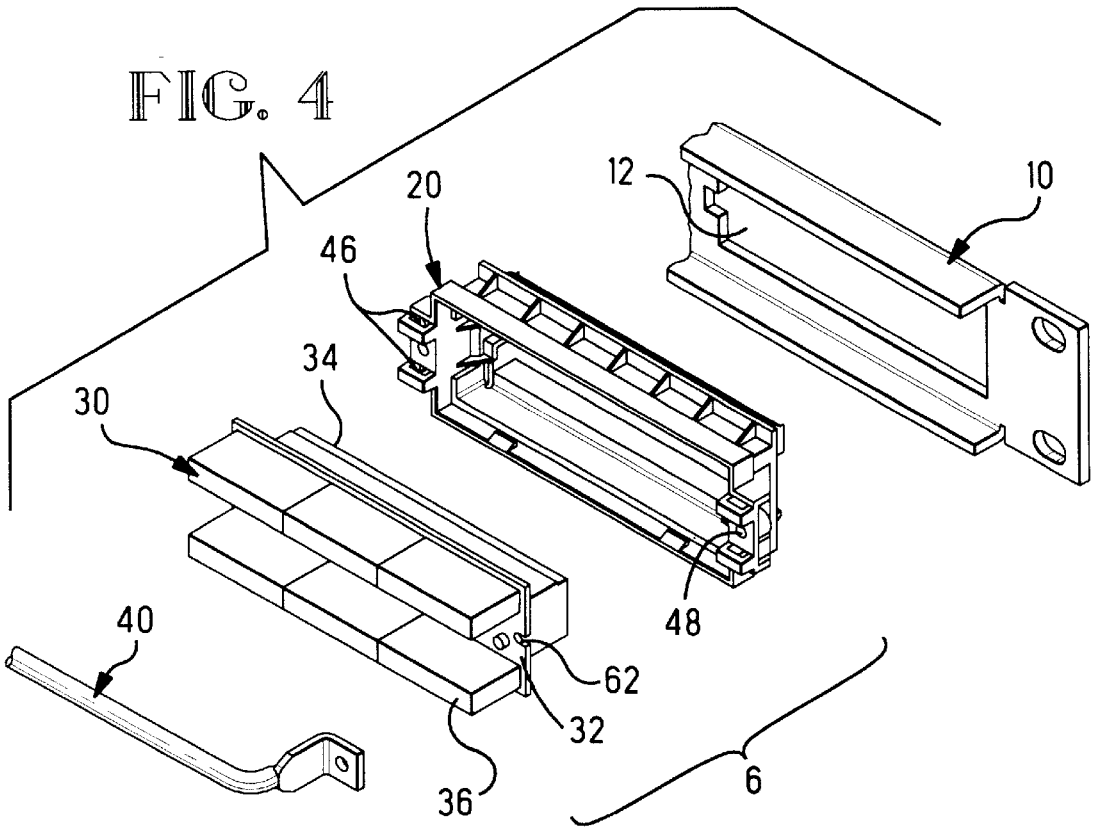

PATCH PANEL HAVING SNAP TOGETHER CONSTRUCTION

FIELD OF THE INVENTION

The invention relates to a patch panel for a telecommunications system.

BACKGROUND OF THE INVENTION

A patch panel for the telecommunications industry typically comprises a mounting panel having a plurality of connectors mounted thereto. A patch panel sold by AMP Incorporated of Harrisburg, Pa. has connectors which are mounted on a circuit board, and the circuit board is attached to a mounting panel by threaded fasteners. This construction is labor intensive to manufacture. Further, in the event of a malfunction with one of the connectors, the entire circuit board must be removed for repair or replacement.

U.S. Pat. No. 5,385,488 discloses a patch panel having a plurality of connectors which are individually removable for repair or replacement in the event of a connector malfunction. Each of the connectors is supported in a respective mount, and the mount is removably held in a panel. However, the connector is not held securely within the mount until the mount is secured to the panel. Instead, the connector is slidably supported in guide channels of the mount. An edge of the panel confines the connector to a fixed position along the guide channels when the mount is secured to the panel, thereby preventing withdrawal of the connector from the mount. Thus, in order to remove the connector from the panel, the mount must also be removed from the panel.

There is a need for a patch panel with a simple connector mounting system which enables the connectors to be individually removed.

SUMMARY OF THE INVENTION

It is an object of the invention to provide a patch panel which can be easily assembled.

It is another object of the invention to provide a patch panel having a connector assembly which can be easily removed for repair or replacement.

It is a further object of the invention to provide a patch panel having a connector assembly which can be removed without removal of other parts.

These and other objects are accomplished by a patch panel comprising a mounting panel having an aperture therethrough, an interface housing removably attached to the mounting panel by first snap latch means, the interface housing having an opening therethrough in alignment with the aperture, and a connector assembly disposed in the opening and removably attached to the interface housing by second snap latch means.

In a preferred embodiment the first snap latch means includes a pair of resilient latches on the interface housing which are captured in the aperture between opposed interior edges of the mounting panel, and the second snap latch means includes opposed resilient latches on the interface housing which capture a circuit board of the connector assembly.

BRIEF DESCRIPTION OF THE DRAWINGS

The invention will now be described by way of example with reference to the accompanying drawings wherein:

FIGS. 3 and 4 are front and rear isometric views of an end portion of the patch panel assembly;

DETAILED DESCRIPTION OF THE PREFERRED EMBODIMENT

Figure 1:
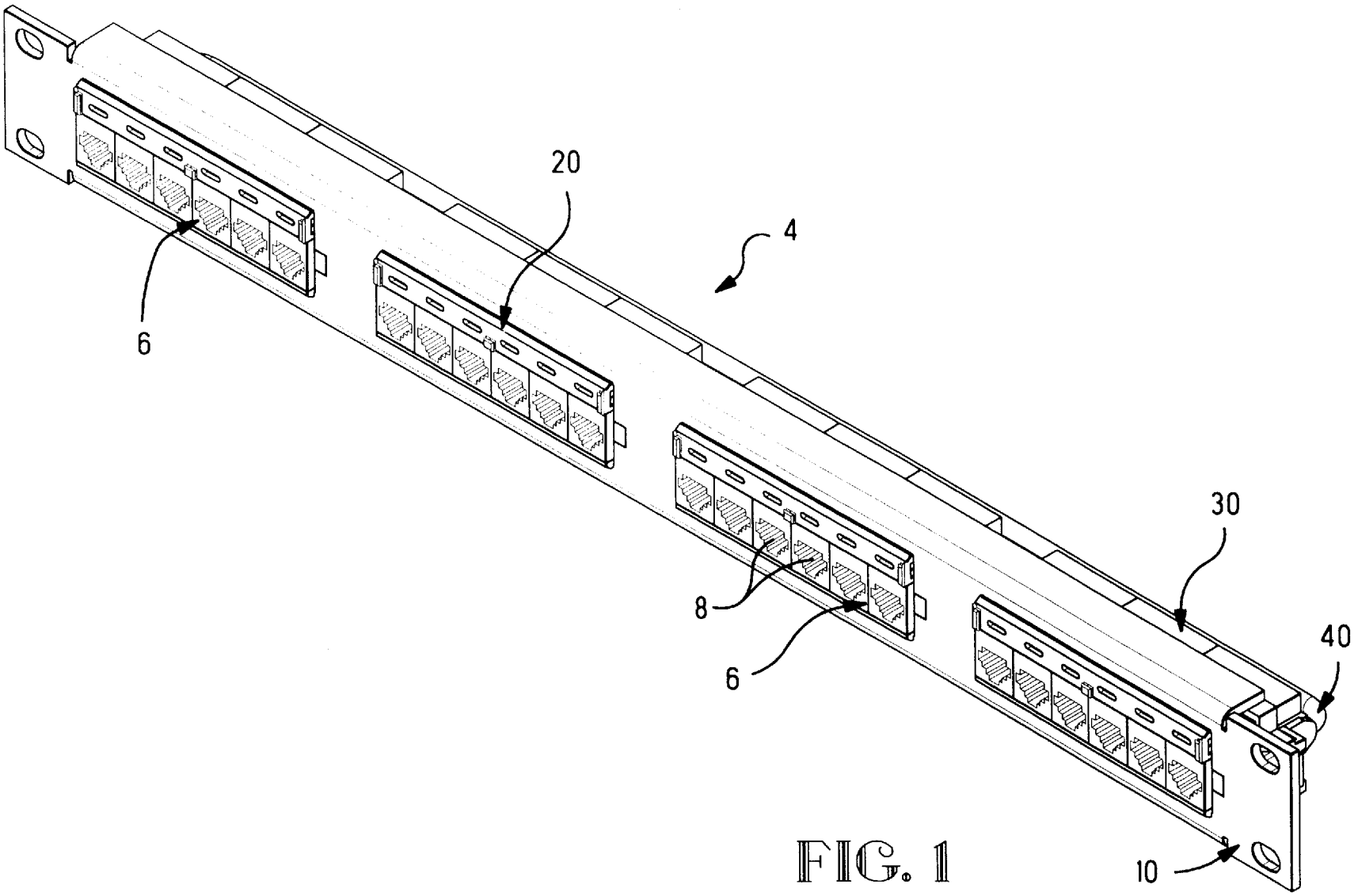
FIGS. 1 and 2 are front and rear isometric views of a patch panel assembly according to the invention.
Figure 2:
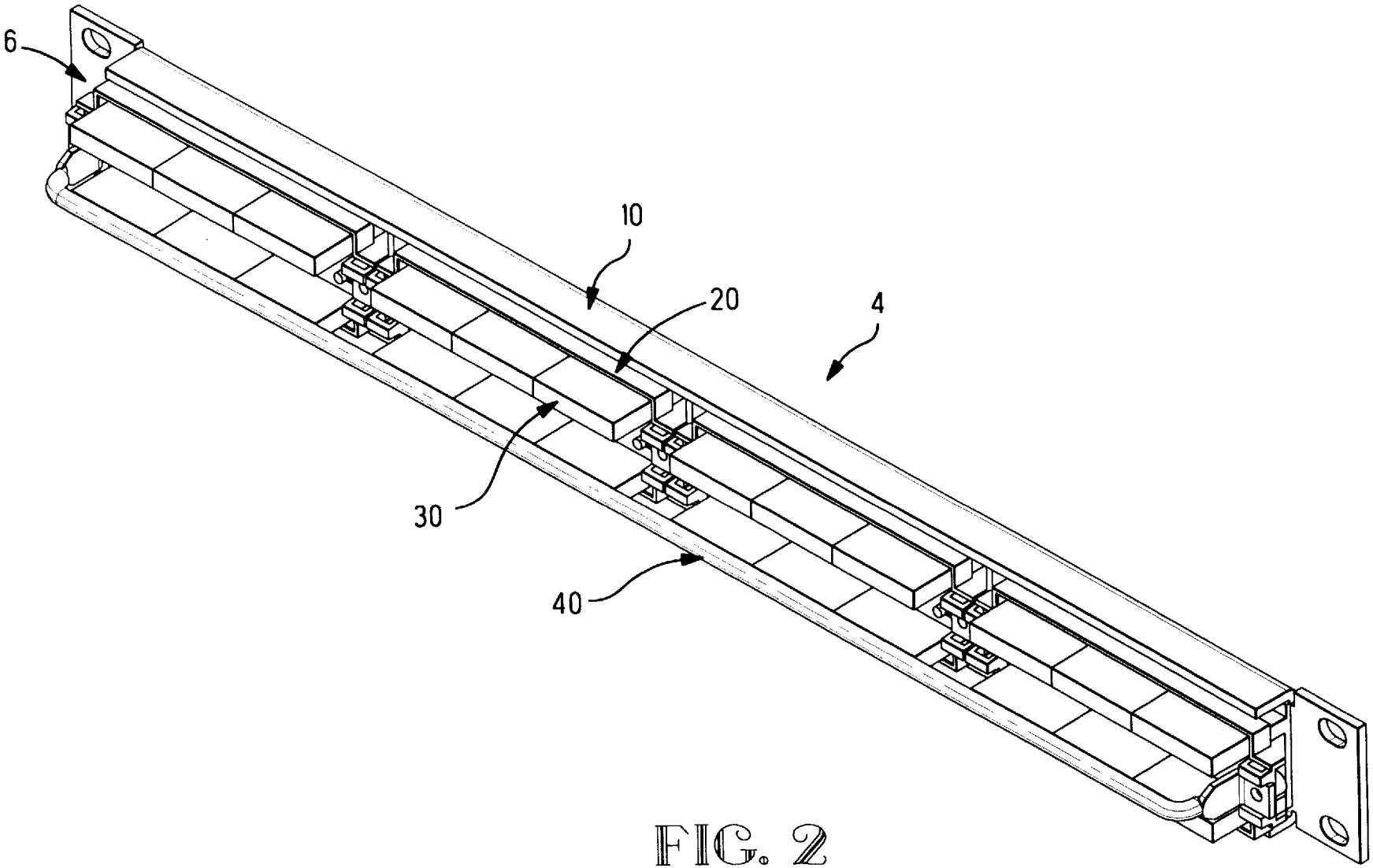
Figure 5:
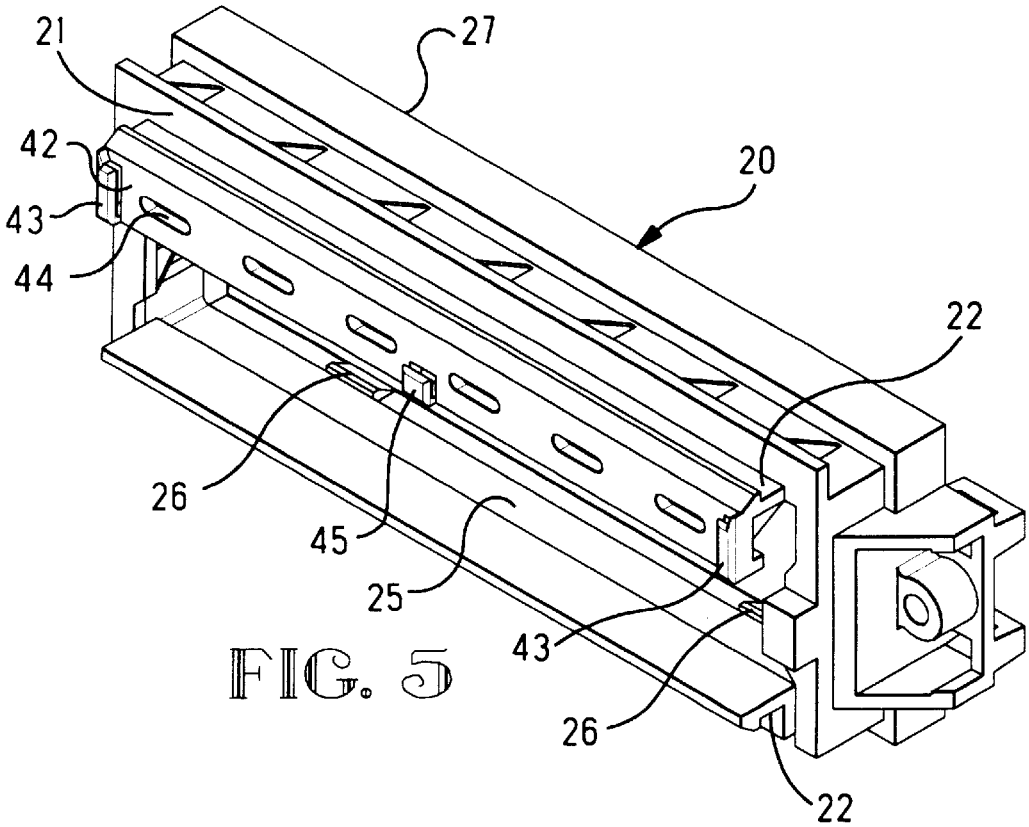
FIGS. 5 and 6 are front and rear isometric views of an interface housing used in the patch panel assembly.

There is shown in FIGS. 1 and 2 a multi-port patch panel 4 which serves as a mounting platform for a plurality of electrical connectors. As shown, the multi-port patch panel has four connector assembly modules 6, and each of the modules includes six electrical connector ports 8, such as modular jacks, which can receive mating connectors terminated to electrical wiring in a communications network. However, it should be understood that a patch panel according to the invention can be constructed with any number of the connector assembly modules 6, and each of the modules may in turn include some other number and type of the connector ports 8.

The invention will be described with reference to a portion of the multi-port patch panel having one of the connector assembly modules 6, as shown in FIGS. 3 and 4. The patch panel comprises a mounting panel 10, an interface housing 20, and a connector assembly 30. The module 6 comprises the interface housing 20 and the connector assembly 30.

The mounting panel 10 is preferably stamped and formed from metal sheet material. The mounting panel has an aperture 12 in which the interface housing is mounted. The mounting panel has holes 14 which receive threaded fasteners for attaching the patch panel to frame rails of a mounting rack (not shown).

The interface housing 20 is preferably made from a substantially rigid plastic material which exhibits some compliancy and resilience With reference to FIGS. 5–8, the interface housing 20 is removably attached to the mounting panel 10 by a first snap latch means comprising a pair of resilient latch arms 22 which extend from a front 21 of the interface housing. Each of the latch arms 22 carries a latch shoulder 23 and has a beveled leading edge 24. The beveled edges 24 engage interior edges 14 of the mounting panel surrounding the aperture 12 and cam the latch arms 22 inwardly as the arms are inserted through the aperture. As the latch shoulders 23 pass beyond the front surface 16 of the mounting panel, the latch arms 22 spring back with a snap action and provide a tactile indication that the interface housing 20 is secured to the mounting panel 10. The interface housing can be removed from the mounting panel by deflecting the latch arms 22 so that the latch shoulders 23 clear the interior edges 14 of the mounting panel.

With reference to FIGS. 3, 4, 7 and 8, the connector assembly 30 includes a substrate 32 such as a circuit board. On one side of the board 32 are mounted one or more connectors 34 such as modular jacks, and on the other side are mounted one or more connectors 36 such as 110 style connecting blocks. The circuit board electrically connects the connectors 34 and 36 and integrates them into a single unit which is the connector assembly 30. Margins 38 of the circuit board are exposed for retention to the interface housing 20 as will now be described.

The interface housing 20 has an opening 25 in which the connector assembly 30 is mounted, and a second snap latch means for removably securing the connector assembly thereto. The second snap latch means comprises latch tabs 26 which project inwardly from a shroud 27 at the rear of the interface housing. The latch tabs 26 have beveled edges 28 and shoulders 29. The connector assembly 30 is attached to the interface housing 20 by urging the circuit board 32 against the beveled edges 28 so as to deflect the tabs 26 on the shrouds 27 outwardly until the margins 38 of the circuit board are captured behind the shoulders 29 with a snap action. With the interface housing 20 attached to the mounting panel 10l the connector assembly 30 can be removed by prying on the shrouds 27 to deflect the tabs 26 outwardly and release the circuit board.

It should be apparent that instead of capturing the margins 38 of the circuit board behind the tabs 26, the connector assembly could be constructed with alternative projecting ears which would be captured by the second snap latch means.

Figure 6:
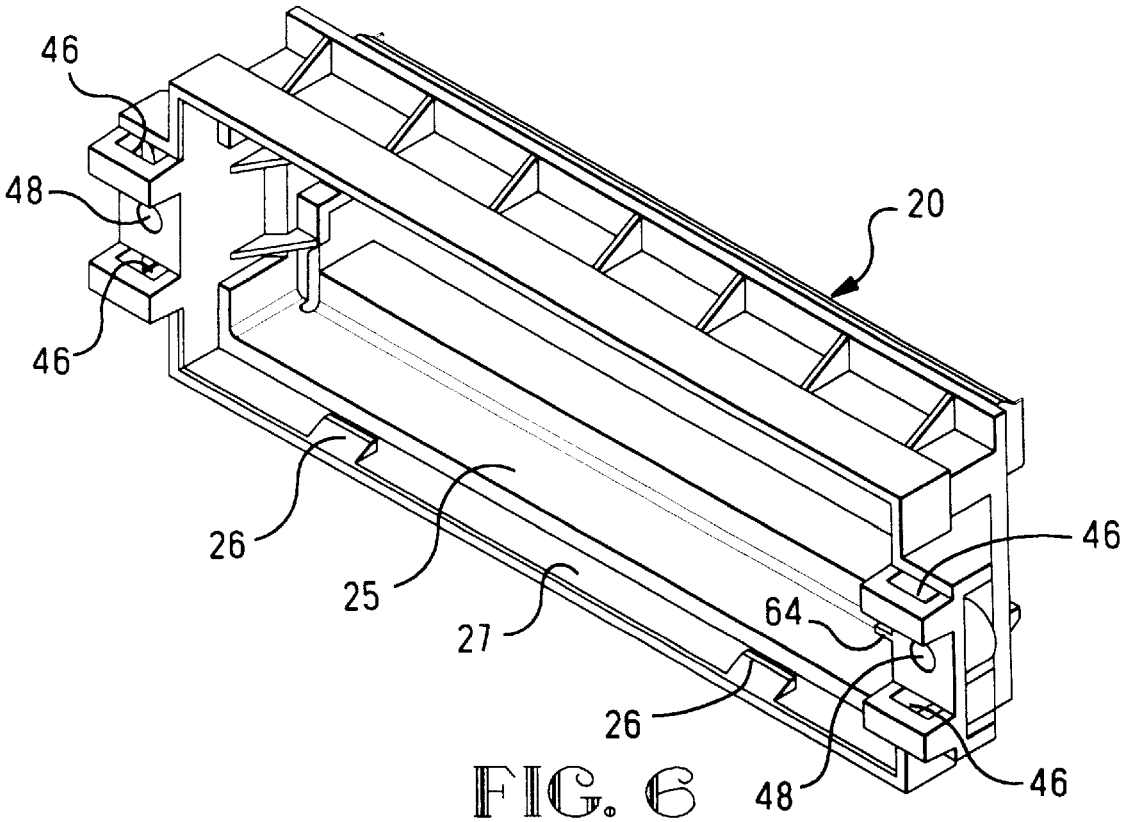
Figure 7:
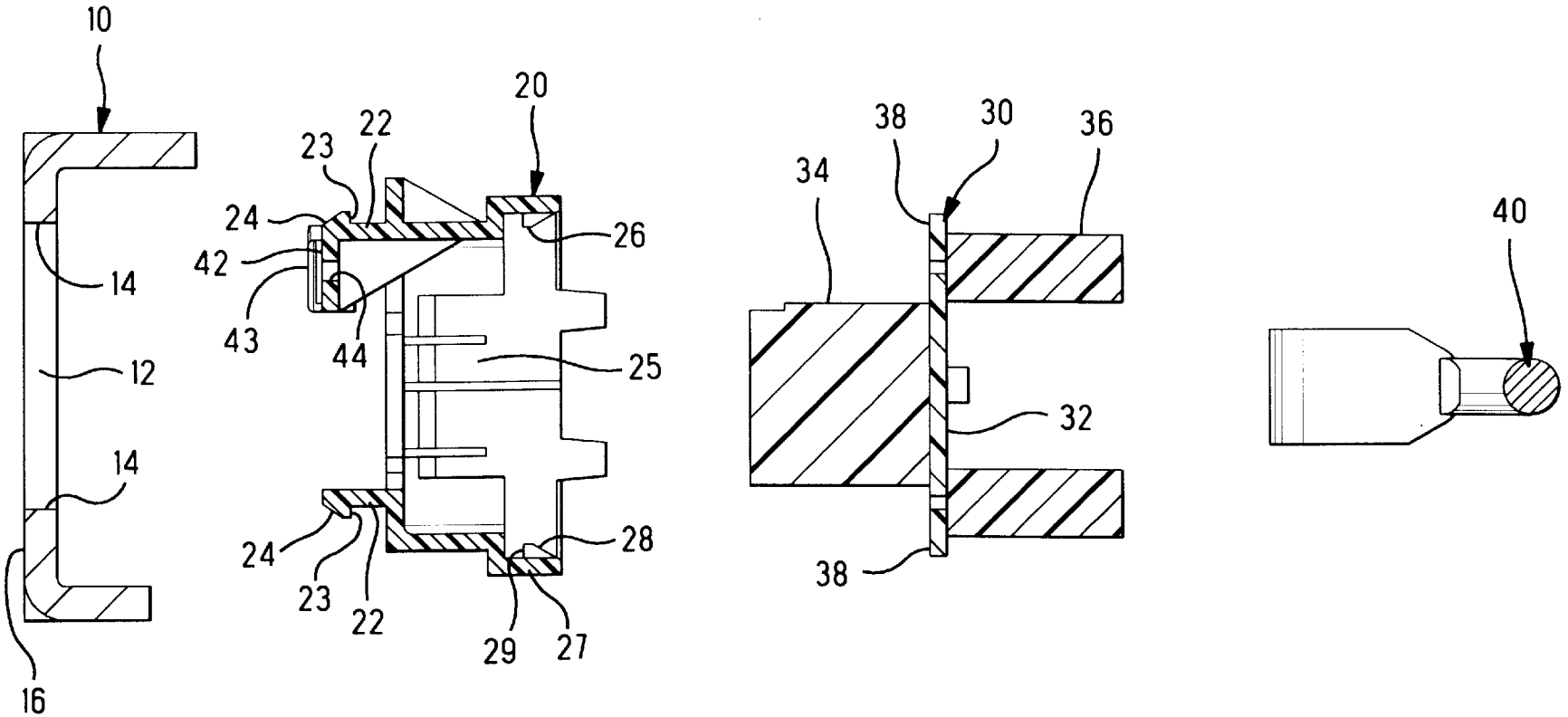
FIGS. 7 and 8 are cross-sectional views showing components of the patch panel assembly in exploded and assembled condition, respectively.
Figure 8:
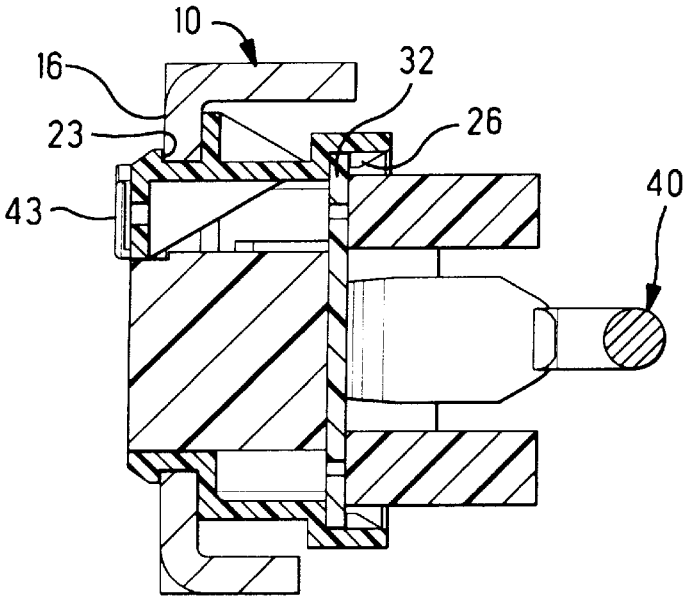

The circuit board has a polarizing notch 62 along one edge which receives a rib 64 of the interface housing, as shown in FIG. 6, to ensure correct orientation of the connector assembly 30 in the interface housing 20.

The interface housing 20 has a valance 42 which extends downwardly from the upper latch arm 22. The valance 42 provides a mounting platform for either a label or icons (not shown) which identify the connector ports on the patch panel. The valance has tabs 43,45 behind which a thin label is insertable The valance also has apertures 44 which can receive fasteners for the icons if the label is not being applied to the valance.

Figure 10:
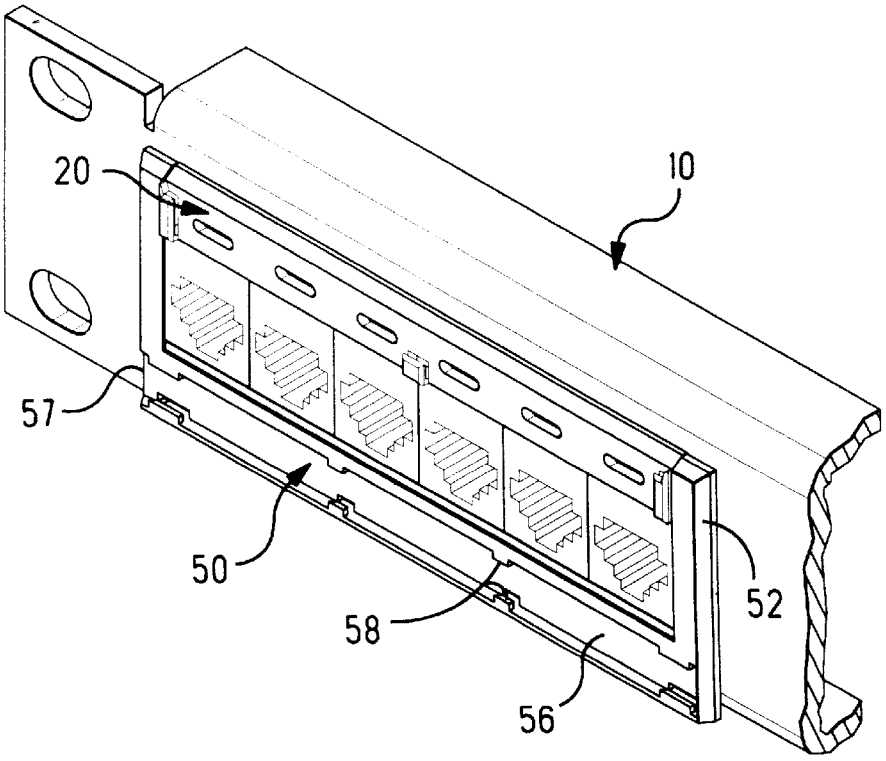
FIGS. 9 and 10 are isometric views of the patch panel assembly wherein a label holder is shown in exploded and assembled condition, respectively.
Figure 9:
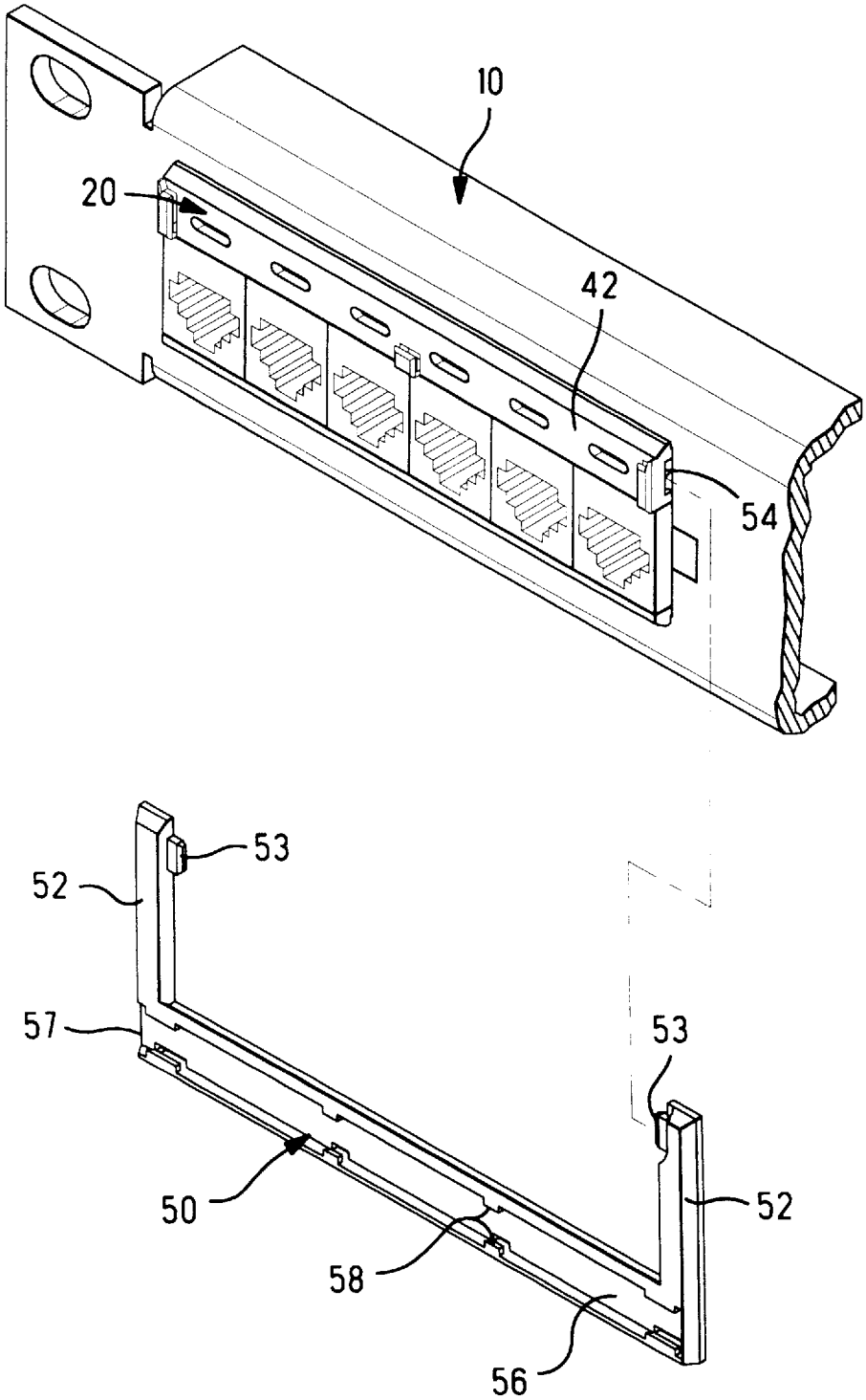

With reference to FIGS. 9 and 10, the patch panel optionally includes a label holder 50. The label holder 50 has snap acting means including arms 52 with projecting tabs 53 which are received in pockets 54 behind opposite ends of the valance 42 on the interface housing with a snap fit. The label holder 50 has a slot 56 which slidably receives a thin label (not shown). The slot has an open end 57 through which the label is insertable, and tabs 58 retain the label in the slot.

Referring back to FIG. 6, the interface housing has bosses with holes 48 which can receive threaded fasteners (not shown) for attaching a handle 40, as best seen in FIG. 4, to the patch panel. The handle is especially useful to position and maneuver the patch panel in a mounting rack while protecting the connectors 34 and 36 against damage. When the handle is not attached to the interface housing, lugs or holddowns 46 can receive wire ties (not shown) for securing and organizing conductor wires which are attached to the connectors at the back of the connector assembly.

The invention provides a patch panel having a simple snap together construction. The patch panel has first snap latch means whereby an interface housing is removably attached to a mounting panel, and second snap latch means whereby a connector assembly is removably attached to the interface housing. The first and second snap latch means are independent so that the connector assembly can be removed from the patch panel without removal of the interface housing.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

I claim:

1. A patch panel for a telecommunications system, comprising:

a mounting panel having an aperture therethrough;

an interface housing which is inserted into the aperture from a rear of the mounting panel and removably attached to the mounting panel by first snap latch means which is releasable from a front of the mounting panel, the interface housing having an opening therethrough in alignment with the aperture; and a connector assembly which is inserted into in the opening and from a rear of the mounting panel and removably attached to the interface housing by second snap latch means, wherein the connector assembly prevents release of the first snap latch means when the connector assembly is disposed in the opening and wherein the connector asembly is replaceable without removal of the interface housing from the mounting panel.

2. The patch panel according to claim 1, wherein the first snap latch means includes a pair of resilient latches on the interface housing which are captured in the aperture between opposed interior edges thereof.

3. The patch panel according to claim 1, wherein the second snap latch means includes opposed resilient latches on the interface housing, the connector assembly includes a circuit board, and the circuit board is captured by the opposed resilient latches of the interface housing.

4. The patch panel according to claim 1, wherein the interface housing includes a holddown for a wire tie.

5. The patch panel according to claim 1, further comprising a label holder removably attached to the interface housing by snap acting means.

6. The patch panel according to claim 1, further comprising a handle attached thereto.

* * * * *